US012320062B2

(12) United States Patent
Hand et al.

(10) Patent No.: US 12,320,062 B2
(45) Date of Patent: Jun. 3, 2025

(54) FLAME RETARDANT COMPOSITIONS WITH LOW FORMALDEHYDE CONTENT

(71) Applicant: ENERGY SOLUTIONS (US) LLC, Princeton, NJ (US)

(72) Inventors: Geoffrey Hand, West Midlands (GB); John Davis, Worcestershire (GB); Gary Woodward, Cheshire (GB)

(73) Assignee: Energy Solutions (US) LLC, Princeton, NJ (US)

( * ) Notice: Subject to any disclaimer, the term of this patent is extended or adjusted under 35 U.S.C. 154(b) by 969 days.

(21) Appl. No.: 16/061,037

(22) PCT Filed: Dec. 8, 2016

(86) PCT No.: PCT/EP2016/080239

§ 371 (c)(1),
(2) Date: Jun. 11, 2018

(87) PCT Pub. No.: WO2017/097894

PCT Pub. Date: Jun. 15, 2017

(65) Prior Publication Data

US 2020/0277729 A1 Sep. 3, 2020

(30) Foreign Application Priority Data

Dec. 11, 2015 (EP) ..... 15306990

(51) Int. Cl.
*D06M 15/673* (2006.01)
*D06M 13/285* (2006.01)
*D06M 13/432* (2006.01)

(52) U.S. Cl.
CPC ..... *D06M 15/673* (2013.01); *D06M 13/285* (2013.01); *D06M 13/432* (2013.01); *D06M 2200/30* (2013.01)

(58) Field of Classification Search
CPC ..... D06M 15/673; D06M 15/285; D06M 13/285; D06M 13/432; D06M 2200/13; D06M 13/673; D06M 13/431; D06M 13/313; D06M 13/322; D06M 2200/30
USPC ..... 442/142; 252/8.61, 8.6, 8.8, 8.63, 608; 106/18.12, 18.15, 18.18, 18.19; 8/115.7, 8/127.1, 128.1, 115.6, 115.64, 194, 196
See application file for complete search history.

(56) References Cited

U.S. PATENT DOCUMENTS 4,311,855 A * 1/1982 Cole ..... C09K 21/12 252/608
5,688,429 A * 11/1997 Zakikhani ..... D06M 15/431 252/8.61
2011/0092119 A1 4/2011 Cliver et al.
2015/0056374 A1 2/2015 Deschietere et al.

FOREIGN PATENT DOCUMENTS

CN 104311876 A * 1/2015
EP 0709518 A1 5/1996

* cited by examiner

*Primary Examiner* — Camie S Thompson
(74) *Attorney, Agent, or Firm* — Osha Bergman Watanabe & Burton LLP

(57) ABSTRACT

The instant invention relates to a composition useful as a precursor for imparting flame-retardant properties to textile articles, comprising a condensate of: (a) a tetrakis (hydroxy-organo) phosphonium sulfate THPS; (b) urea, or alternatively thiourea; (c) optionally, and preferably, an aliphatic hydroxyl-reactive compound, such an amine wherein said composition has a very low free formaldehyde content, namely of less than 0.1%.

14 Claims, No Drawings

FLAME RETARDANT COMPOSITIONS WITH LOW FORMALDEHYDE CONTENT

This application is a U.S. national phase entry under 35 U.S.C. § 371 of International Application No. PCT/EP2016/080239, filed Dec. 8, 2016, which claims priority to European Application No. 15306990.1, filed Dec. 11, 2015. The entire contents of these applications are explicitly incorporated herein by this reference.

The instant invention relates to compositions useful for imparting flame-retardant properties to textile articles, that comprise a precursor that reacts under ammonia curing to form a polymer, said polymer imparting the sought flame retardant properties when applied on the textile article. The precursor is a condensate of (i) a tetrakis (hydroxyorgano) phosphonium salt (also referred as "$THP^+$ salt"); and (ii) urea and/or thiourea (herein referred as "(thio)urea").

Flame retardant treatment making use of such a condensate of $THP^+$ salt and (thio)urea are well known and has been described e.g. in the European patent application EP 0 709 518. In this treatment, the fabric to be treated is generally impregnated with the condensate of the $THP^+$ salt and (thio)urea (optionally together with an amine as described in EP 0 709 518, such as an aliphatic amine having 12 carbon atoms or more, such as n-docecylamine; n-octadecylamine, n-hexadecylamine, and/or n-eicosylamine) and, typically, the fabric is then dried and then cured with ammonia ($NH_3$) whereby a phosphonium-based polymer is produced within the fibers of the fabric, which is mechanically fixed to the fabric. After the curing, the obtained polymer is generally oxidized in order to convert at least a part of the trivalent phosphorus (carried by the phosphonium group) into a pentavalent phosphorous (an phosphine oxide group). Examples of fabrics treated according to this process and textile articles and garments made thereof are those sold under the tradename PROBAN®. Example of condensates of $THP^+$ salt and (thio)urea useful for a flame retardant of the type described above are those available under the tradename PERFORM®, for Example PERFORM® CC or PERFORM® STI.

Due to $THP^+$ salt, the condensate as described above tend to contain formaldehyde HCHO. In the condensate of this type that have been described and used hitherto, the free formaldehyde content is systematically of more than 0.1%. Herein, the term "free formaldehyde content" refers to the formaldehyde content by weight on the basis of total weight of composition including the condensate (which is generally an aqueous solution).

The presence of formaldehyde in the precursor is problematic given of the toxicity of HCHO. This can be an issue especially during the storage and transportation, and when handling and using the precursor.

One aim of the instant invention is to provide flame-retarding precursor having a reduced content of formaldehyde, that renders it more suitable for storage, transportation and handling. Especially, the invention aims at providing a precursor in line with the regulation regarding formaldehyde content.

To this end, the instant invention provide a precursor with a low formaldehyde content, that can be obtained by making use of a specific $THP^+$ salt, namely THP sulfate.

In the scope of the instant invention, the inventors have now surprisingly found that it is possible to produce a condensate of $THP^+$ salt and (thio)urea having a formaldehyde content of less than 0.1% by making use of $THP^+$ sulfate (herein referred as "THPS") instead of the $THP^+$ chloride (noted "THPC" herein).

This result obtained with THPS is especially unexpected in view of the HCHO contents usually observed when using THPC. Usually, manufacturing a condensate of $THP^+$ salt and (thio)urea needs an elevation of the pH of the $THP^+$ salt (the condensate is formed at a pH of about 5 when the salt has a natural pH which is lower). The pH elevation is obtained by a caustic treatment, namely an addition of a strong base such as KOH or NaOH, that tend to react with the $THP^+$ cation and form formaldehyde. And it is well known that it is difficult to manage the formaldehyde formation during the caustic treatment. The inventors have now found that the use of THPS makes it possible to have a control sufficient for limiting the formation of formaldehyde at a content that is kept under 0.1% or even well lower.

In addition, the inventors have now found that the condensates having this reduced formaldehyde content (especially those obtained according to the process of the attached examples) display a significant reduced odour during application to the textile compared with condensates described in the prior art.

According to a first aspect, the instant invention relate to the compositions obtainable by making use of the THPS. More precisely, one subject-matter of the instant invention is a composition comprising a product (herein referred as "condensate") obtained by reaction of the following compounds:

(a) a tetrakis (hydroxyorgano) phosphonium sulfate (herein "THPS");

(b) urea or thiourea (herein "(thio)urea");

(c) optionally an aliphatic hydroxyl-reactive compound such an amine, said composition having a free formaldehyde content of less than 0.1%.

According to another aspect, another subject-matter of the instant invention is a process for preparing a composition as defined above, comprising a reaction of the aforementioned compounds (a); (b); and optionally (c), namely THPS; (tho)urea; and optionally an aliphatic hydroxyl-reactive compound such an amine, in conditions leading to a free formaldehyde content of less than 0.1%.

The tetrakis (hydroxyorgano) phosphonium sulfate (THPS) used in the scope of the instant invention is preferably a tetrakis (hydroxyalkyl) phoshonium sulfate. More preferably, it is a tetrakis (hydroxmethyl) phoshonium sulfate.

Different features and specific embodiments of the invention are described in more details herein-after.

The Compositions

According to a first variant, the composition of the invention contains, as the precursor, a product obtained by reaction of:

(a) a tetrakis (hydroxyorgano) phosphonium sulfate (herein "THPS"), preferably a a tetrakis (hydroxmethyl) phoshonium sulfate;

(b) urea or thiourea (herein "(thio)urea")

without any additional aliphatic hydroxyl-reactive compound such an amine.

Preferably, in that case, the molar ratio (a)/(b) in the condensate present in a composition of the invention (ratio of the quantity of $THP^+$ cation to the quantity of urea) is in the range of 1.5:1 to 4:1, for example in the range of 2:1 to 3:1.

Alternatively, according to a second variant, the composition of the invention contains, as the precursor, a product obtained by reaction of:

(a) a tetrakis (hydroxyorgano) phosphonium sulfate (herein "THPS"), preferably a tetrakis (hydroxymethyl) phosphonium sulfate;
(b) urea or thiourea (herein "(thio)urea"); and
(c) an aliphatic hydroxyl-reactive compound such an amine.

According to this second variant, the aliphatic hydroxyl-reactive compound is preferably a compound comprising an aliphatic chain, typically an alkyl group, having at least 12 carbon atoms, for example 12, 13, 14, 15, 16, 17 or 18 carbon atoms.

Besides, the aliphatic hydroxyl-reactive compound (c) is preferably selected from the group consisting of:
primary amines, that may be in all or part in their protonated form
secondary amines , that may be in all or part in their protonated form
tertiary amines, that may be in all or part in their protonated form
diamines, that may be in all or part in one of their protonated forms
quaternary ammonium salt distinct from a $THP^+$ salt
ethoxylated amines
ethoxylated diamines
mixtures of at least two of the aforementioned compounds.

According to a preferred embodiment, the aliphatic hydroxyl-reactive compound (c) is an amine, preferably a primary amine, comprising an alkyl group, having at least 12 carbon atoms, for example 12, 13, 14, 15, 16, 17 or 18 carbon atoms. An especially preferred aliphatic hydroxyl-reactive compound (c) is a primary alkylamine wherein the alkyl chain comprise 12, 13 or 14 carbon atoms. The n-dodecylamine, n-tridecylamine and n-tetradecylamine are for example suitable amines.

Whatever the exact nature of the compound (c), it is preferred that, in the condensate present in a composition according to the second variant, the molar ratio (a)/(b+c) (ratio of the quantity of compound (a) in mole, to the sum of the quantities of compounds (b) and (c) in mole) is in the range of 1.5:1 to 4:1, preferably in the range of 2:1 to 4:1, for example in the range of 2.5:1 to 3:1.

A composition according to the invention generally comprises the product resulting of the reaction of compounds (a) and (b) or the product resulting of the reaction of compounds (a), (b) and (c) dissolved in water. Alternatively, the composition of the invention may comprise additional products, provides that they do not interfere with the reaction of the precursor during the ammonia curing, for example a water soluble solvent.

The Preparation of the Composition

The preparation of a composition of the invention makes use of a reaction of compound (a), namely THPS, with at least compound (b), this reaction being typically carried out by heating the mixture. The inventors have found that, in order to decrease the HCOH content in the compositions of the invention, it is preferable that the reaction of compounds (a) and (b) takes place at a temperature lower than the temperatures commonly use in the prior art (especially lower than the reflux conditions taught in EP 709 518). Accordingly, it is preferred that the reaction of compounds (a) and (b) takes place at a temperature of less than 100° C., more preferably at a temperature of less than 90° C. (for example between 50 and 90° C., e.g between 80 and 85° C.).

Preferably, before reacting compound (a), the process includes a step of adjusting the pH of compound (a), advantageously in order to obtain compound (a) in water at a pH of between 5.0 and 6.0, the value 6.0 being preferably excluded (in other words, a pH of less than 6.0—for example of less than 5.9 or even of less than 5.8—is preferred). Advantageously, the step of adjusting the pH of compound (a) allows to obtain compound (a) in water at a pH of between 5.0 and 5.7, more preferably in the range of 5. To 5.5. This step of adjusting the pH generally includes the addition of a base, e.g. a strong base such as NaOH or KOH, to the compound (a) in water, in order to have the compound (a) at a pH, since typically, the pH of a THPS after its preparation is of about 4.5. The inventors have now unexpectedly found that this step leads to a well lower formation of formaldehyde than in the case of THPC, which allow to obtain a final condensate with a reduced content of formaldehyde, provided that the THPS initially contains a sufficiently low content of formaldehyde. Preferably, the compound (a) used in the process of the invention contains less than 0.1%, preferably less than 0.05% of free formaldehyde before the step of adjusting pH. After the reaction of compound (a) with compound (b) and optionally (c), the content of free formaldehyde is generally not higher than, and most often lower than the content of free formaldehyde in the initial compound (a). The process may also comprise a step of adjusting the pH, that however does not lead, if any, to a substantial formation of formaldehyde.

For preparing a composition according to the first variant (reaction of compound (a) and (b) without any compound (c)), the compound (b) is typically added to the compound (a) preliminarily placed at a pH of between 5.0 and 6.0, and more preferably in the aforementioned pH conditions where the value of 6.0 is excluded, an then the mixture is heated (preferably below 100° C., and more preferably below 90° C.) and compounds (a) and (b) are allowed to react. The pH is optionally adjusted after the reaction.

Hence, typically, the process preparing a composition according to the first variant comprises the following successive steps:
(1.1.) placing the compound (a) in water and adjusting the pH between 5.0 and 6.0, typically by addition of sodium hydroxide to a compound (a) initially at a pH of about 4.5 (and preferably initially comprising less than than 0.1%, preferably less than 0.05% of free formaldehyde);
(1.2) mixing the compound (b) and the medium obtained in step (1.1), preferably by adding the compound (b) progressively;
(1.3) allowing compounds (a) and (b) to react, preferably at a temperature lower than 100° C., for example at a temperature of between 50 and 90° C., typically during 30 minutes to 4 hours, for example between 1 and 3 hours.

For preparing a composition according to the second variant (reaction of compound (a) (b) and (c)), the compound (a) is preferably reacted first with compound (c) (preferably without any (b)) and then only the product obtained by the reaction of compounds (a) and (c) is reacted with compound (b). The inventors have found that this order of the steps induces a reduction of the formation of formaldehyde.

Before the reaction with compounds (c) and (b) (in that order or alternatively (c) and then (b) even if not preferred), the compound (a) is preferably preliminarily placed at a pH of between 5.0 and 6.0, more preferably between 5.0 and 5.5.

Besides, for preparing a composition according to the second variant (global reaction of compounds (a); (b); and (c)), the reaction of compound (b) with compound (a), or—more preferably—with the product obtained by the reaction of compounds (a) and (c), is carried out a a temperature of less than 100° C., more preferably at a temperature of less than 90° C. (for example between 50 and 90° C., e.g between 80 and 85° C.).

Typically, the process preparing a composition according to the second variant comprises the following successive steps:

(2.1.) placing the compound (a) in water and adjusting the pH between 5.0 and 6.0, typically by addition of sodium hydroxide to a compound (a) initially at a pH of about 4.5 (and preferably initially comprising less than than 0.1%, preferably less than 0.05% of free formaldehyde);

(2.2) mixing the compound (c) and the medium obtained in step (2.1), preferably by adding the compound (c) progressively (and typically at a temperature sufficient for allowing a proper dispersion of the compound (c));

(2.3) allowing compounds (a) and (c) to react, typically at a temperature of less than 90°, more preferably of less than 80° C., for example between 30° C. and 60° C. (or alternatively to higher temperature, for example between 90° c. and 104° C., even if not preferred), typically during 30 minutes to 6 hours, for example between 1 and 3 hours (2.4.) mixing the compound (b) and the medium obtained in step (2.3), preferably by adding the compound (b) progressively, and typically at a temperature lower than 80° C., more;

(2.5) allowing compound (b) to react with the product formed in step (2.3), preferably at a temperature of less than 100° C., preferably of less than 90° C., for example between about 50 and 90° C. (for example between 80 an 85° C.), typically during 30 minutes to 4 hours, for example between 1 and 3 hours.

The invention will now be further illustrated by the following illustrative examples.

EXAMPLE 1

1A. THPS-Urea Condensate

A THPS-urea condensate according to the first variant of the invention (phosphonium:urea ratio of 2:1) has been prepared as followed:

2400 g tetrakis(hydroxymethyl)phosphonium sulfate solution (75% w/w THPS, 4.43 moles) was treated with 12 g of 50% w/w sodium hydroxide solution to give a mixture with a pH of 5.6. The mixture was heated in an oil-jacketed reactor to 40° C. and 266 g urea (4.43 moles) added in three portions over 15 minutes.

The reaction mixture was then heated to 80-85° C., held at that temperature for 1.5 hours to complete the reaction, and then cooled. The pH of the cooled product was 4.7 and further additions of 20 g 50% w/w sodium hydroxide solution and 70 g water were made as final adjustments.

The final product was analysed as follows.

| | |
|---|---|
| Assay (as THPS) | 64.9% w/w |
| pH | 5.4 |
| SG at 20° C. | 1.375 |

Measurement of free formaldehyde in the THPS starting material and the final reaction product gave the following results.

| | |
|---|---|
| Initial THPS | 0.09% w/w HCHO |
| THPS-urea condensate | 0.07% w/w HCHO |

The THPS-urea condensate as obtained in this example displays significantly reduced odour during application to textile.

Effect of the Reaction Temperature

In order to illustrate the effect of the temperature of the reaction between compounds (a) and (b) in the instant invention, the above example has been reproduced, with the same conditions, except that the reaction mixture was then heated to 100° C. instead of 80-85° C., and held at 100-104° C. for 1.5 hours to complete the reaction. In these conditions, a final content of HCHO greater than 0.1% was obtained in the THPS-urea condensate (more precisely: 0.15% w/w HCHO even when starting from a THPS having an initial content of 0.09% w/w HCHO).

1B. THPC-Urea Condensate

For seek of comparison, a THPC-urea (with the same phosphonium:urea ratio of 2:1 as in Example 1 B) has been prepared as followed:

900 g tetrakis(hydroxymethyl)phosphonium chloride (82% w/w THPC, 3.87 moles) was treated with 58.1 g 25% w/w sodium hydroxide solution to give a mixture with a pH of 5.37.

A portion of this was set aside and the remaining 915.5 g (containing 860 g THPC, 3.70 moles) was charged to an oil-jacketed reactor and heated to 45-50° C.

110 g urea (1.83 moles) was added in three equal portions and the reaction mixture heated to approximately 85° C. and held at that temperature for 1 hour. The product was then cooled and adjusted with a further 17.4 g 25% w/w sodium hydroxide solution and 55.7 g water.

Measurement of free formaldehyde in the THPC starting material, the THPC after the initial pH adjustment and the final reaction product gave the following results.

| | |
|---|---|
| THPC | 0.05% w/w HCHO |
| THPC, pH 5.37 | 0.33% w/w HCHO |
| THPS-urea condensate | 0.12% w/w HCHO |

EXAMPLE 2

THPS-Amine-Urea Condensates

The examples of EP 0 709 518, that make use of THPC, have been reproduced and the free formaldehyde content has been measured. This content is systematically of more than 0.3%

On the contrary, a THPS-amine-urea condensate prepared in similar conditions systematically lead to a free formaldehyde of less than 0.1%, especially when temperature is controlled: urea and a C18 amine as used in EP 0 709 518 were added to THPS instead of THPC (with a molar ratio THPS:urea:amine of 2.5:0.95:0.05—addition at 45° C.), and then heated at 80° C. The final free formaldehyde was of less than 0.09%.

The content of free formaldehyde has been found even lower if the amine is added first: in the same conditions, by adding first the amine at 45° C. to the THPS, reacting at 104° C., then cooling at 45° C. and adding the C18 amine and heating at 85° C. for 90 minutes, the final free formaldehyde was of less than 0.06%.

More precisely, a THPS-amine-urea condensate with a formaldehyde content of 0.04% wt/wt was obtained as follows:

1200 g tetrakis(hydroxymethyl)phosphonium sulfate solution (75% w/w THPS, 2.22 moles) was charged to an oil-jacketed reactor and heated to 60° C. 12.4 g tetradecylamine (0.058 moles) was added and the mixture heated to 100-105° C. and held at that temperature for 75 minutes. The resulting reaction mixture was then cooled to 43° C. and 88.7 g urea (1.48 moles) was added in three portions over 20 minutes. The reaction mixture was re-heated to 80-85° C. and held at that temperature for 1.5 hours. After cooling an addition of 80 g water was made as a final adjustment.

The final product was analysed as follows.

| | |
|---|---|
| Assay (as THPS) | 64.7% w/w |
| pH | 4.1 |
| SG at 20° C. | 1.355 |

Measurement of free formaldehyde in the THPS starting material and the final reaction product gave the following results.

| | |
|---|---|
| THPS | 0.05% w/w HCHO |
| 780JD134 | 0.04% w/w HCHO |

The THPS-amine-urea condensates as obtained in this example furthermore display significantly reduced odour during application to textile.

Effect of the Reaction Temperature

The above example has been reproduced by reacting the urea at a higher temperature (more than 100° C. instead of less than 85%), which leads to a HCOH content of 0.28%:

1200 g tetrakis(hydroxymethyl)phosphonium sulfate solution (75% w/w, 2.22 moles) was treated with 12 g 24% w/w sodium hydroxide solution to give a mixture with a pH of 5.6. The mixture was heated to 40° C. in an oil-jacketed reactor and 88.7 g urea (1.48 moles) was added in three portions over about 15 minutes, followed by 12.4 tetradecylamine (0.058 moles). The mixture was heated to 100° C. and maintained at 100-104° C. for 3 hours. After cooling, the final solution strength was adjusted by the addition of 65 g water.

The final product analysed as follows.

| | |
|---|---|
| Assay (as THPS) | 66.1% w/w |
| pH | 3.5 |
| S.G. at 20° C. | 1.359 |

Measurement of free formaldehyde in the THPS starting material and the final reaction product gave the following results.

| | |
|---|---|
| THPS | 0.06% w/w |
| 780JD078 | 0.28% w/w |

The invention claimed is:

1. A polymer precursor composition comprising a condensate of compounds comprising:

(a) a tetrakis (hydroxyorgano) phosphonium sulfate in water having a pH in a range from 5.0 to 5.7;

(b) urea or thiourea; and (c) an aliphatic hydroxyl-reactive compound having from 12 to 18 carbon atoms, wherein the molar ratio of (a)/((b)+(c)) is in a range from 1.5:1 to 4:1, and wherein said polymer precursor composition has a free formaldehyde content of less than 0.1% by weight, based on the total weight of the composition; and wherein the condensate is produced at a reaction temperature of less than 100° C.

2. The polymer precursor composition of claim 1, wherein the pH of (a) is in a range from 5.0 to 5.5.

3. The polymer precursor composition of claim 1, wherein the molar ratio of (a)/((b)+(c)) is in a range from 2:1 to 4:1.

4. The polymer precursor composition of claim 1 wherein said tetrakis (hydroxyorgano) phosphonium sulfate is tetrakis (hydromethyl) phosphonium sulfate.

5. The polymer precursor composition of claim 4 wherein said aliphatic hydroxyl-reactive compound (c) is an amine compound.

6. The polymer precursor composition of claim 1 wherein said aliphatic hydroxyl-reactive compound (c) is an amine compound.

7. The polymer precursor composition of claim 6 wherein the aliphatic hydroxyl-amine compound is one or more member selected from the group consisting of: n-dodecylamine; n-tridecylamine; and n-tetradecylamine.

8. The polymer precursor composition of claim 1 wherein the aliphatic hydroxyl-amine compound is one or more member selected from the group consisting of: n-dodecylamine; n-tridecylamine; and n-tetradecylamine.

9. The polymer precursor composition according to claim 1, wherein the condensate is produced at a reaction temperature of 80-85° C.

10. A process of preparing a polymer precursor composition having a free formaldehyde content of less than 0.1% by weight, based on the total weight of the composition form a condensate of:

a. a tetrakis (hydroxyorgano) phosphonium sulfate; and b. a urea or thiourea;

c. an aliphatic hydroxyl-reactive compound having from 12 to 18 carbon atoms, said process comprising the following successive steps:

(2.1.) placing the compound (a) in water and adjusting the pH to a range from 5.0 to 5.7;

(2.2) mixing the compound (c) and the mixture obtained in said step (2.1);

(2.3) allowing the mixture obtained in said step (2.2) to react at a temperature lower than 90° C. to 115° C.;

(2.4) mixing the compound (b) and the reaction product obtained in said step (2.3);

(2.5) allowing the mixture obtained in said step (2.4) to react at a temperature of less than 100° C., and for a period of time from 0.5 hour to 4 hours, wherein the molar ratio of (a)/((b)+(c)) is in a range of 1.5:1 to 4:1.

11. The process of claim 10 wherein said aliphatic hydroxyl-reactive compound (c) is an amine compound.

12. The process of claim 11 wherein the aliphatic hydroxyl-amine compound is one or more member selected from the group consisting of: n-dodecylamine; n-tridecylamine; and n-tetradecylamine.

13. The process of claim 12 wherein said tetrakis (hydroxyorgano) phosphonium sulfate is tetrakis (hydromethyl) phosphonium sulfate.

14. The process according to claim 13 wherein the pH of the mixture of compound (a) in water is adjusted to a range of 5.0 to 5.5.

* * * * *